US007919151B2

(12) United States Patent
Deng et al.

(10) Patent No.: US 7,919,151 B2
(45) Date of Patent: Apr. 5, 2011

(54) METHODS OF PREPARING WETTING-RESISTANT SURFACES AND ARTICLES INCORPORATING THE SAME

(75) Inventors: Tao Deng, Clifton Park, NY (US); Pazhayannur Ramanathan Subramanian, Niskayuna, NY (US); Ming Feng Hsu, Niskayana, NY (US); Yuk-Chiu Lau, Ballston Lake, NY (US); Margaret L. Blohm, Schenectady, NY (US); Wayne Charles Hasz, Pownal, VT (US); Nitin Bhate, Rexford, NY (US); Kripa Kiran Varanasi, Clifton Park, NY (US); Gregory Allen O'Neil, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 1094 days.

(21) Appl. No.: 11/610,542

(22) Filed: Dec. 14, 2006

(65) Prior Publication Data

US 2008/0145528 A1 Jun. 19, 2008

(51) Int. Cl.

| | |
|---|---|
| ***C23C 26/00*** | (2006.01) |
| ***C23C 26/02*** | (2006.01) |
| ***C23C 30/00*** | (2006.01) |

(52) U.S. Cl. ..... 427/419.1; 427/203; 427/383.1; 427/419.7

(58) Field of Classification Search ..... None
See application file for complete search history.

(56) References Cited

U.S. PATENT DOCUMENTS

| | | | | |
|---|---|---|---|---|
| 5,549,927 | A | 8/1996 | Cottone et al. | |
| 6,083,631 | A | 7/2000 | Neff | |
| 6,120,568 | A | 9/2000 | Neff | |
| 6,402,464 | B1 * | 6/2002 | Chiu et al. | 415/116 |
| 6,426,152 | B1 * | 7/2002 | Johnson et al. | 428/553 |
| 6,468,669 | B1 * | 10/2002 | Hasz et al. | 428/553 |
| 6,505,673 | B1 * | 1/2003 | Abuaf et al. | 164/45 |
| 6,526,756 | B2 | 3/2003 | Johnson et al. | |
| 6,541,124 | B1 | 4/2003 | Suggs | |
| 6,546,730 | B2 | 4/2003 | Johnson et al. | |
| 6,589,600 | B1 * | 7/2003 | Hasz et al. | 427/264 |
| 6,598,781 | B2 | 7/2003 | Hasz et al. | |
| 6,649,682 | B1 | 11/2003 | Breton et al. | |
| 6,786,982 | B2 | 9/2004 | Lee et al. | |
| 6,800,354 | B2 | 10/2004 | Baumann et al. | |
| 6,846,575 | B2 | 1/2005 | Hasz et al. | |

(Continued)

FOREIGN PATENT DOCUMENTS

| | | | |
|---|---|---|---|
| EP | 0 037 837 | * | 8/1985 |

(Continued)

*Primary Examiner* — Jennifer C McNeil
*Assistant Examiner* — Jason L Savage
(74) *Attorney, Agent, or Firm* — Paul J. DiConza

(57) ABSTRACT

The present invention provides methods for manufacturing an article having a wetting-resistant surface. The method includes providing a substrate. The method further includes disposing a coating mixture on a surface of the substrate, wherein the coating mixture comprises a braze material and a texture-providing material. The method further includes heating the braze material to bond the texture-providing material to the surface of the substrate to form the article having the wetting-resistant surface.

47 Claims, 7 Drawing Sheets

U.S. PATENT DOCUMENTS

| | | | | |
|---|---|---|---|---|
| 6,852,389 | B2 | 2/2005 | Nun et al. | |
| 6,872,441 | B2 | 3/2005 | Baumann et al. | |
| 6,910,620 | B2 | 6/2005 | Hasz et al. | |
| 7,036,397 | B2 | 5/2006 | Bangert | |
| 2004/0131877 | A1 * | 7/2004 | Hasz et al. | 428/614 |
| 2004/0166355 | A1 * | 8/2004 | Lee et al. | 428/553 |
| 2005/0014010 | A1 | 1/2005 | Dumm et al. | |
| 2005/0230155 | A1 | 10/2005 | Sung | |
| 2005/0271514 | A1 * | 12/2005 | Lee et al. | 416/244 A |
| 2006/0162817 | A1 * | 7/2006 | Boger et al. | 148/23 |

FOREIGN PATENT DOCUMENTS

| | | | | |
|---|---|---|---|---|
| EP | 0037837 | B1 | | 8/1985 |
| EP | 0 671 242 | | * | 9/1994 |
| EP | 0671242 | A1 | | 9/1995 |
| EP | 1 009 592 | | * | 3/1998 |
| EP | 1009592 | B1 | | 6/2000 |
| EP | 1050663 | B1 | | 11/2000 |
| EP | 1 050 663 | | * | 8/2006 |
| WO | WO97/29157 | A1 | | 8/1997 |
| WO | 97/29157 | | * | 9/1997 |

* cited by examiner

METHODS OF PREPARING WETTING-RESISTANT SURFACES AND ARTICLES INCORPORATING THE SAME

BACKGROUND

The invention relates generally to methods of modifying the surface of an article. More particularly, the invention relates to methods of preparing wetting-resistant surfaces. The invention also relates to articles with surfaces exhibiting wetting resistance.

Hydrophobic and super-hydrophobic surfaces are desirable in numerous applications, such as windows, DVD disks, cooking utensils, clothing, medical instruments, automotive and aircraft parts, textiles, and like applications. Typically hydrophobic surfaces have been created by changing surface chemistry or by increasing the surface roughness via surface texturing so as to increase the true or effective surface area, or by combining both of these methods. Altering the surface chemistry of the surface typically involves coating the surface with a hydrophobic coating. However, most of such hydrophobic coatings suffer from poor adhesion to the surface, lack mechanical robustness, and are prone to scratches. Moreover, most of the existing techniques for altering the wetting resistance of the surface suffer from certain drawbacks, such as processes that are time consuming, difficult to control, expensive or ineffective in producing films with sufficient durability. Therefore, there is a need for an inexpensive, easy, and effective means for achieving surfaces with wetting resistance.

BRIEF DESCRIPTION

Embodiments of the present invention meet these and other needs. In one embodiment of the present invention, a method for manufacturing an article having a wetting-resistant surface is provided. The method includes providing a substrate. The method further includes disposing a coating mixture on a surface of the substrate, wherein the coating mixture comprises a braze material and a texture-providing material. The method further includes heating the braze material to bond the texture-providing material to the surface of the substrate to form the article having the wetting-resistant surface, wherein the wetting-resistant surface has a surface area enhancement of greater than about 1.2.

In another embodiment of the present invention, a method for manufacturing an article having a wetting-resistant surface is provided. The method includes providing a substrate and disposing a coating mixture on a surface of the substrate, wherein the coating mixture comprises a braze material and a texture-providing material, and wherein the texture-providing material comprises a plurality of particles having a median size of less than about 1 micrometer in at least one dimension. The method further includes heating the braze material to bond the texture-providing material to the surface of the substrate to form the article having the wetting-resistant surface.

In yet another embodiment of the present invention, a method for manufacturing an article having a wetting-resistant surface is provided. The method includes providing a substrate. The method further includes disposing a coating mixture on a surface of the substrate, wherein the coating mixture comprises a braze material and a texture-providing material. The texture-providing material comprises a plurality of particles having surface features disposed on their surfaces. The method further includes heating the braze material to bond the texture-providing material to the surface of the substrate to form the article having the wetting-resistant surface.

In yet another embodiment of the present invention, an article comprising a substrate is provided. A coating is disposed on a surface of the substrate, wherein the coating comprises a texture-providing material, wherein the texture-providing material is bonded to the surface of the substrate by a braze material and wherein the wetting-resistant surface has a surface area enhancement of greater than about 1.2.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
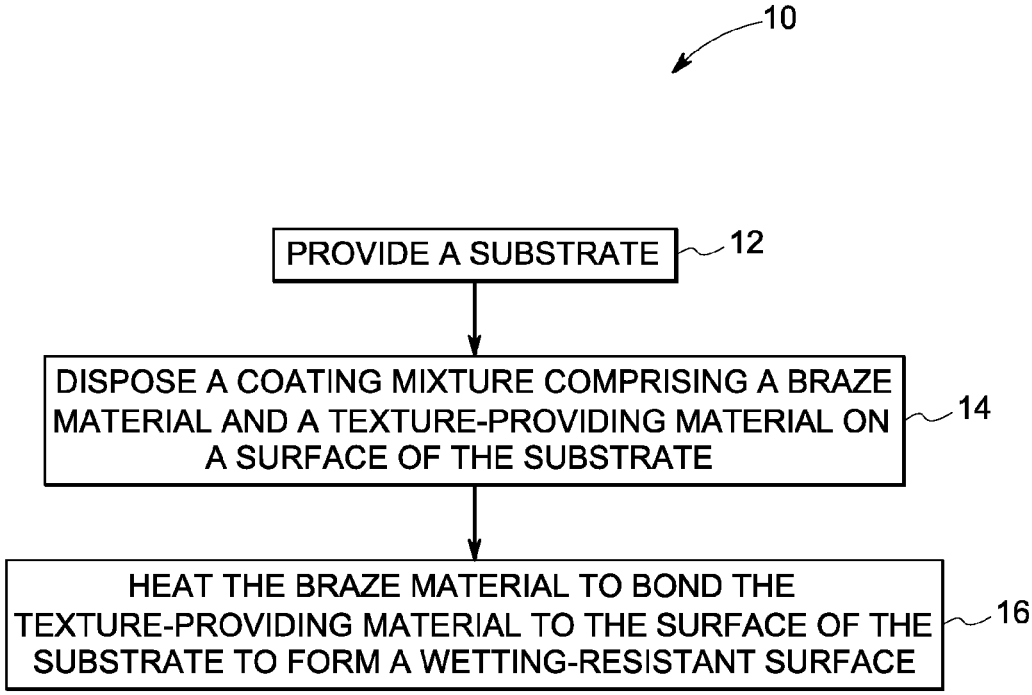
FIG. 1 is a flow chart of a method for manufacturing an article having a wetting-resistant surface, according to embodiments of the present invention.

The "wetting resistance" of a substrate surface is determined by observing the nature of the interaction occurring between the surface and a drop of a reference liquid disposed on the surface. The droplets, upon contact with a surface, may initially spread over a relatively wide area, but often contract to reach an equilibrium contact area. Droplets contacting a surface having a low wetting resistance to the liquid tend to remain spread over a relatively wide area of the surface (thereby "wetting" the surface). In the extreme case, the liquid spreads into a film over the surface. On the other hand, where the surface has a high wetting resistance for the liquid, the liquid tends to contract to well-formed, ball-shaped droplets. In the extreme case, the liquid forms nearly spherical drops that either roll off of the surface at the slightest disturbance or lift off of the surface due to impact momentum. As used herein, the term "wetting-resistant" refers to surfaces that are resistant to wetting by reference liquids.

The extent to which a liquid is able to wet a substrate surface plays a significant role in determining how the liquid and the surface will interact with each other. A high degree of wetting results in relatively large areas of liquid-surface contact, and is desirable in applications where a considerable amount of interaction between the two surfaces is beneficial, such as, for example, adhesive and coating process applications. Conversely, for applications requiring low solid-liquid interaction, the resistance to wetting is generally kept as high as possible in order to promote the formation of liquid drops having minimal contact area with the solid surface.

Many applications would benefit from the use of wetting-resistant surfaces and components having these surfaces that are resistant to wetting by liquid droplets. For example, aircraft components, such as airframe and engine components, and wind turbine components are susceptible to icing due to super-cooled water that remains in contact with the surface while the droplets freeze and accumulate as an agglomerated mass of ice. This may reduce the efficiency of the components and eventually may cause damage to these components.

As used herein, the term "contact angle" is referred to as the angle a stationary drop of a reference liquid makes with a horizontal surface upon which the droplet is disposed. As used herein, the term "inherent contact angle" is referred to as the angle a stationary drop of a reference liquid makes with a horizontal, flat and un-textured surface upon where the droplet is disposed, and is measured at the liquid/substrate interface. When the surface is flat and un-textured, the contact angle the reference liquid makes with the surface will be the same as the inherent contact angle.

Contact angle is used as a measure of the wettability of the surface. If the liquid spreads completely on the surface and forms a film, the contact angle is 0 degrees. As the contact angle increases, the wetting resistance increases. The terms "hydrophobic" and "super-hydrophobic" are used to describe surfaces having very high wetting resistance to water. As used herein, the term "hydrophobic" will be understood to refer to a surface that generates a contact angle of greater than about 90 degrees with water. As used herein, the term "super-hydrophobic" will be understood to refer to a surface that generates a contact angle of greater than about 120 degrees with water. Because wetting resistance depends in part upon the surface tension of the reference liquid, a given surface may have a different wetting resistance (and hence form a different contact angle) for different liquids.

As used herein, the term "substrate" is not construed to be limited to any shape or size, as it may be a layer of material, multiple layers or a block having at least one surface of which the wetting resistance is to be modified.

As used herein, the term "surface area enhancement" is referred to as the ratio of the total surface area of the surface to the projected surface area of the surface.

According to embodiments of the present invention, a method for manufacturing an article having a wetting-resistant surface is provided. A wetting-resistant surface, in one embodiment, exhibits resistance to wetting by water. In another embodiment, the wetting-resistant surface exhibits resistance to wetting by other liquids such as, for example, alcohols and the like.

Turning now to the figures, FIG. 1 is a flow chart 10 of a method for manufacturing an article having a wetting-resistant surface, according to embodiments of the present invention. The method includes providing a substrate, in step 12. The substrate comprises at least one surface.

In one embodiment, the material constituting the substrate comprises a metal. Exemplary metals include steel, stainless steel, nickel, titanium, aluminum or any alloys thereof. In some embodiments, the metal comprises a titanium-based alloy, an aluminum-based alloy, a cobalt-based alloy, a nickel-based alloy, an iron-based alloy or any combinations thereof. Further, the alloy may be a superalloy. In one particular embodiment, the superalloy is nickel-based or cobalt-based, wherein nickel or cobalt is the single largest elemental constituent by weight. Illustrative nickel-based alloy includes at least about 40 weight percent of nickel, and at least one component from the group consisting of cobalt, chromium, aluminum, tungsten, molybdenum, titanium and iron. Examples of nickel-based superalloys are designated by the trade names Inconel®, Nimonic®, Rene® (e.g., Rene®80, Rene®95, Rene®142 and Rene®N5), and Udimet®, and include directionally solidified superalloys and single crystal superalloys. Illustrative cobalt-based alloys include at least about 30 weight percent cobalt and at least one component from the group consisting of nickel, chromium, aluminum, tungsten, molybdenum, titanium and iron. Examples of cobalt-based superalloys are designated by the trade names Haynes®, Nozzalloy®, Stellite® and Ultimet®.

In one particular embodiment, the substrate made of metals or their alloys are designed for high temperature applications. In one embodiment, the temperature is greater than about 400 degrees Celsius (° C.). In some embodiments, the temperature is greater than about 1000° C.

In some embodiments, the material constituting the substrate comprises a ceramic. Non-limiting examples of a ceramic includes an oxide, a mixed oxide, a nitride, a boride or a carbide. Examples of suitable ceramics include, but are not limited to, carbides of silicon or tungsten; nitrides of boron, titanium, silicon, or titanium; stibinite ($SbS_2$), and titanium oxynitride.

The substrate may form a component or a part of a component for which having one or more than one wetting-resistant surface would be desirable. In one embodiment, the substrate comprises a component of an aircraft. Non-limiting exemplary components of aircraft include a wing, a fuselage, a tail, and an aircraft engine component. Non-limiting exemplary aircraft engine components include a nacelle lip, a splitter leading edge, a booster inlet guide vane, a fan outlet guide vane, a fan blade, a turbine blade, a turbine vane, and a sensor shield.

In some embodiments, the substrate comprises a component of a turbine assembly. In some embodiments, the turbine assembly is selected from the group consisting of a gas turbine assembly, a steam turbine assembly, and a wind turbine assembly. In a wind turbine assembly, icing is a significant problem as the build-up of ice on various components such as anemometers and turbine blades reduces the efficiency and increases the safety risks of wind turbine operations. In one embodiment, the substrate forms a component of the wind turbine selected from the group consisting of a turbine blade, an anemometer, and a gearbox. Exemplary components of the turbine assembly include, but are not limited to, a turbine blade, a low-pressure steam turbine blade, a high-pressure steam turbine blade, a compressor blade, a condenser, and a stator component.

As will be appreciated, the step 12 of providing the substrate also may include pre-treatment processes on the surface of the substrate. In one example, the substrate is cleaned of organic contaminants and/or is polished prior to further processing steps.

In step 14, a coating mixture is disposed on at least one surface of the substrate. The coating mixture comprises a braze material and a texture-providing material, wherein the texture-providing material comprises a plurality of particles.

As noted, the coating mixture includes a braze material, which is a material that mechanically or metallurgically bonds the texture-providing material on at least one surface of the substrate. Typically, sufficient heat is provided to the braze material so as to melt the braze material, wholly or partially, which on cooling, solidifies resulting in the bonding of the braze material to the surface of the substrate along with the texture-providing material. The choice of the braze material may depend on the temperature to which the surface of the substrate may be subjected to without any adverse effect to the substrate. For example, it is typically desirable that the substrate remains intact without any adverse structural changes or chemical changes or property changes during the heating process.

In one embodiment, the braze material comprises a nickel-based alloy, a cobalt-based alloy, an aluminum-based alloy, a titanium-based alloy, a copper-based alloy, or an iron-based alloy. "Nickel-based," "cobalt-based," "aluminum-based," "titanium-based," "copper-based," or "iron-based" alloy generally denotes compositions wherein the above are the single largest elemental constituent by weight in the composition. The braze alloy composition may also contain silicon, boron, phosphorous or combinations thereof, which may serve as melting point suppressants. It is noted that other types of compositions containing silver, gold, or palladium, mixtures thereof, in combination with other metals such as copper, manganese, nickel, chrome, silicon, and boron may be utilized. In some embodiments, the composition of the braze material is similar to that of the substrate. For example, if the substrate is a nickel-based superalloy, the braze material may contain a nickel-based braze alloy; however the melting point of the braze alloy will generally be much lower than that of the substrate.

Exemplary braze alloy compositions include, by weight percent: composition 1: about 3% boron, about 93% nickel, and about 5% tin; composition 2: about 3% boron, about 7% chromium, about 3% iron, about 83% nickel, and about 4% silicon; composition 3: about 19% chromium, about 71% nickel, and about 10% silicon; and composition 4: about 2% boron, about 95% nickel and about 4% silicon. Other example braze alloys include the commercially available Amdry line of braze tapes available from Sulzer Metco. An exemplary grade is Amdry® 100.

The texture-providing material, upon bonding to a substrate, forms a plurality of protrusions that extend beyond the surface of the substrate. The plurality of protrusions together defines a surface area enhancement which appears as a roughened surface that, if performed in accordance with embodiments of the present invention, may be effective in improving the wetting resistance of the surface. Further, the texture-providing material may have a melting point greater than about the melting point of the braze material so that they remain largely intact during the heating step.

In one embodiment, the texture-providing material is of a material that lowers the surface energy of the surface. In one embodiment, the material constituting the texture-providing particles comprises a ceramic. Example ceramic particles include an oxide, a mixed oxide, a nitride, a boride, or a carbide. In one particular example, the nitride comprises boron nitride. In another embodiment, the material constituting the texture-providing particles comprises intermetallic particles. Exemplary intermetallic particles comprise a silicide, an aluminide, or any combinations thereof. In yet another embodiment, the material constituting the texture-providing particles comprises metallic particles. Exemplary metallic particles comprise stainless steel, nickel alloys and the like.

In some embodiments, the texture-providing material comprises a material having an inherent contact angle with a reference liquid that is greater than about 80 degrees; that is, the material has a wettability sufficient to generate a contact angle of at least about 80 degrees with a particular reference liquid. In another embodiment, the texture-providing material comprises a material having an inherent contact angle with a reference liquid that is greater than about 90 degrees. In yet another embodiment, the texture-providing material comprises a material having an inherent contact angle with a reference liquid that is greater than about 100 degrees. In particular embodiments, the reference liquid is water.

The particle size of the texture-providing material is chosen such that the particles provide the desired surface roughness to the at least one surface of the substrate. In one embodiment, the texture-providing material comprises a plurality of particles having a median size of less than about 1000 micrometers in at least one dimension. In some embodiments, the texture-providing material comprises a plurality of particles having a median size in the range from about 10 micrometers to about 250 micrometers in at least one dimension. In yet another embodiment, the texture-providing material comprises a plurality of particles having a median size in the range from about 1 micrometer to about 10 micrometers in at least one dimension. In some embodiments, the texture-providing material comprises a plurality of particles having a median size of less than about 1 micrometer in at least one dimension. In certain embodiments, the texture-providing material comprises a plurality of particles having a median size in the range from about 1 nanometer to about 1 micrometer in at least one dimension.

In one particular embodiment, the plurality of particles constituting the texture-providing material comprises a nanostructured-material. A "nanostructured-material", as used herein, is a structure being of sub-micron size in at least one dimension. Exemplary nanostructures include, but are not limited to, nanoparticles, nanotubes, nanorods, nanowires, and the like. In one embodiment, the nanotube comprises a carbon nanotube.

The shape of the plurality of particles may also contribute to the surface roughness. The plurality of particles constituting the texture-providing material may be defined in terms of a median aspect ratio, wherein the median aspect ratio corresponds to the median of the population of individual particle aspect ratios of the plurality of particles. The aspect ratio, as used herein, refers to the ratio of the largest dimension of the particle to the smallest dimension. For example, for a particle having an elongated cylindrical shape, the aspect ratio refers to the length of the cylinder to the diameter of the cylinder. In one embodiment, the median aspect ratio is greater than about 1. In some embodiments, the median aspect ratio is greater than about 5. In another embodiment, the median aspect ratio is greater than about 10.

In some embodiments, the plurality of particles may be oriented in a particular manner with respect to the surface of the substrate so as to maximize the surface roughness, typically by causing the largest dimension of a particle to protrude above the surface. For example, a nanotube may be aligned perpendicular to the surface of the substrate such that the protrusions are greater as compared to a nanotube aligned parallel to the surface. The alignment of the texture-providing material may be performed using a number of techniques. For example, applying a strong electric or magnetic field during brazing may help to obtain the desired alignment. In one embodiment, the texture providing particles are oriented prior to brazing to generate aligned texturing on the surface.

In one embodiment, the texture-providing material comprises a plurality of particles having surface features disposed on their surfaces. These surface features may advantageously increase the surface area of the plurality of particles which may in turn increase the overall surface roughness. In some embodiments, the surface features may be elevations, such as cylindrical posts, rectangular prisms, pyramidal prisms, dendrites, nanorods, nanotubes, particle fragments, abrasion marks, or any other protrusion above the surface of the particles. Alternatively, surface features may be depressions disposed to some depth below the surface, such as holes, wells, and the like. In one embodiment, the surface features have a median size of less than about 10 micrometers. In some embodiments, the surface features have a median size in the range from about 1 micrometer to about 10 micrometers. In one embodiment, the surface features have a median size of less than about 1 micrometer. Embodiments of the invention also include chemical modification of the texture-providing material by attaching certain functional groups to lower the surface energy of the substrate. Non-limiting examples of such functional groups include a fluorine moiety and a silicone moiety.

The step 14 of disposing the coating mixture comprising the braze material and the texture-providing material is described in detail with reference to FIGS. 2-3. In one embodiment, the coating mixture is substantially free of flux; in a typical brazing process, flux is sometimes used to protect the surface from adverse chemical reaction such as oxidation, for example, and the flux may also clean the surface of the substrate that is to be brazed. Not using the flux may advantageously reduce the number of processing steps. Typically, the added flux may have to be removed after the brazing process. Moreover, in many embodiments of the present invention, it is the surface roughening effect and the surface energy reduction associated with the texture-providing material that produces the resistance to wetting, without relying on contributions by the flux material.

In step 16, the braze material is heated to bond the texture-providing material to the surface of the substrate to form an article having a wetting-resistant surface. Heating the braze material, in one embodiment, includes providing a temperature sufficient enough to melt the braze material, and on cooling, it solidifies to metallurgically or mechanically bond the braze material onto the surface of the substrate along with the texture-providing material. Typically the heating temperatures may depend on the type of braze alloy. For example, in the case of a nickel-based braze material, the braze temperatures are often in the range of about 800° C. to about 1260° C. In some embodiments, the braze temperature is greater than about 450° C. so as to melt the braze material. In another embodiment, the braze temperature is greater than about 1000° C. to melt the braze material. The heating may be carried out in an ambient atmosphere or in some cases within a vacuum furnace. Exemplary heating techniques include use of gas welding torches, radio frequency welding, tungsten inert gas welding, electron beam welding, resistance welding and the use of infrared lamps. Subsequently, the braze material is cooled to form a metallurgical bond at the surface with the texture-providing material mechanically retained within the solidified braze material to form a wetting-resistant surface having protrusions of the texture-providing material.

Optionally, the method may further include modifying the wetting-resistant surface by applying a top coat to further enhance the wetting resistance. In some embodiments, the top coat comprises a silane or a fluorosilane layer. Non-limiting example of a fluorosilane include tridecafluoro 1,1,2,2-tetrahydroflouro octyl trichlorosilane. In some embodiments, the top coat comprises a diamond-like carbon; or oxides such as titanium oxide and tantalum oxide; or carbides such as titanium carbide, tungsten carbide, molybdenum carbide and chromium carbide; or nitrides such as titanium nitride, titanium carbo-nitride, chromium nitride, boron nitride and zirconium nitride; or borides such as tungsten boride and molybdenum boride; or any combinations thereof. The application of a top coat may be performed by depositing the material constituting the top coat from vapor phase or from liquid phase, for example.

Figure 2:
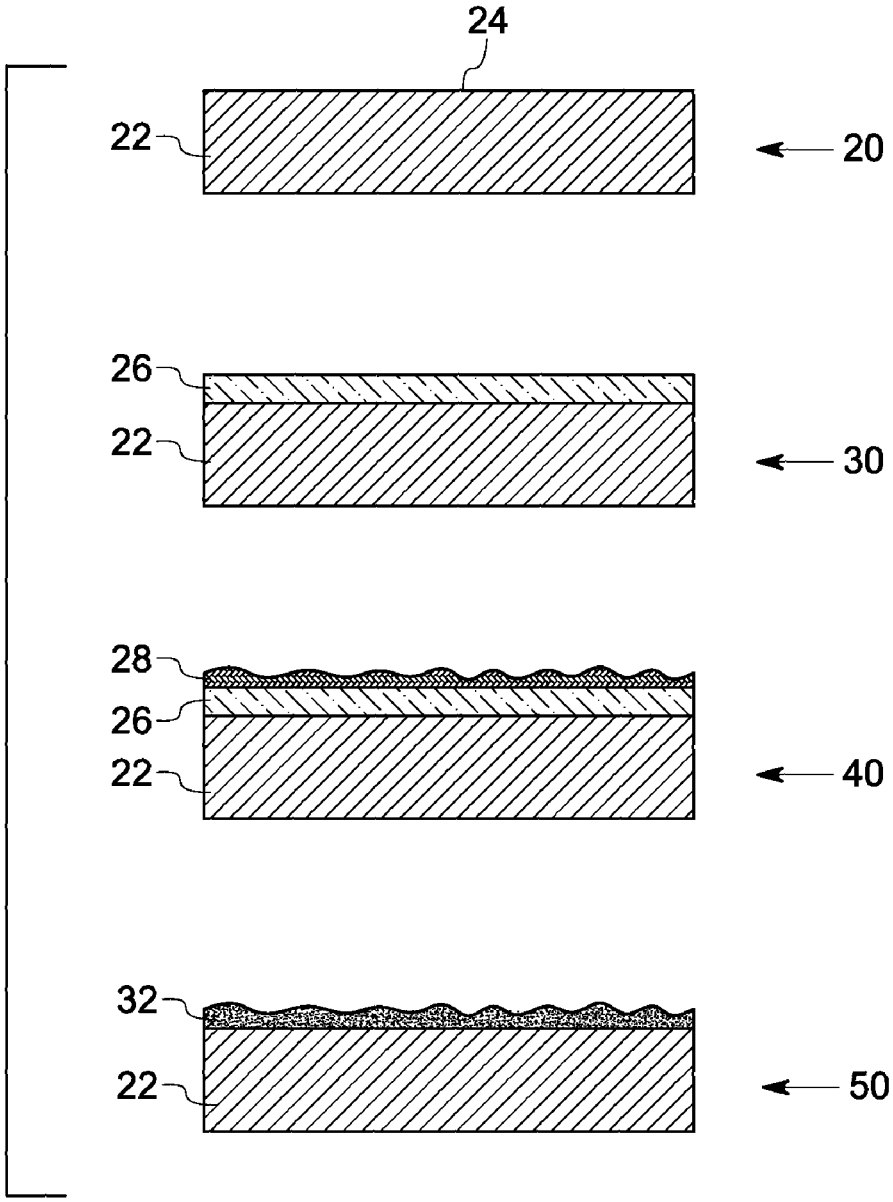
FIG. 2 is a schematic representation of a method for manufacturing an article having a wetting-resistant surface, in one embodiment of the present invention.

FIG. 2 is a schematic representation of a method for manufacturing an article having a wetting-resistant surface, according to some embodiments of the invention. In step 20, a substrate 22 having a surface 24 is provided.

A first coating 26 comprising a braze material is disposed on the surface 24 of the substrate 22, in step 30. The first coating 26, in one embodiment, is a brazing sheet, such as a green braze tape. In one embodiment, the green braze tape is formed from a slurry of powdered braze material and a binder in a liquid medium such as water or an organic liquid. The liquid medium may function as a solvent for the binder. Non-limiting examples of binders include water-based organic materials, such as polyethylene oxide and acrylics. In another embodiment, the first coating 26 comprises a brazing sheet with no binder. The brazing sheet is then attached to the surface 24 of the substrate 22. In one embodiment, the braze tape is attached by means of an adhesive. In some embodiments, the braze tape after placing over the surface is contacted with a solvent that partially dissolves and plasticizes the binder, causing the tape to conform and adhere to the surface of the substrate. In one example, toluene, acetone or another organic solvent could be sprayed or brushed onto the braze tape after the tape is placed on the substrate. In embodiments using a brazing sheet with no binder, the brazing sheet may be attached, for example, by tack welding the sheet to the substrate.

In step 40, a second coating 28 comprising the texture-providing material is disposed on the first coating 26. The texture-providing material, in one embodiment, is disposed as powder over the first coating 26. The powder in turn forms a particulate phase within the braze tape. The size of the particles constituting the powder is determined to a large extent by the degree of surface roughness desired. The powder may be applied randomly over the first coating 26 using techniques such as sprinkling, pouring, blowing, roll-depositing, and the like. The choice of deposition technique may also depend in part on the desired arrangement of powder particles on the first coating 26. In some embodiments, the powder may have a particular orientation on the first coating 26. For example, fibers having an elongated shape may be physically aligned so that their longest dimension extends substantially perpendicular to the surface of the first coating 26.

The first coating 26 comprising the brazing material is heated to bond the second coating 28 comprising the texture-providing material on the surface 24 of the substrate 22, in step 50. The braze material on cooling, solidifies to form a wetting-resistant surface 32 with protrusions created by the texture-providing material.

Figure 3:
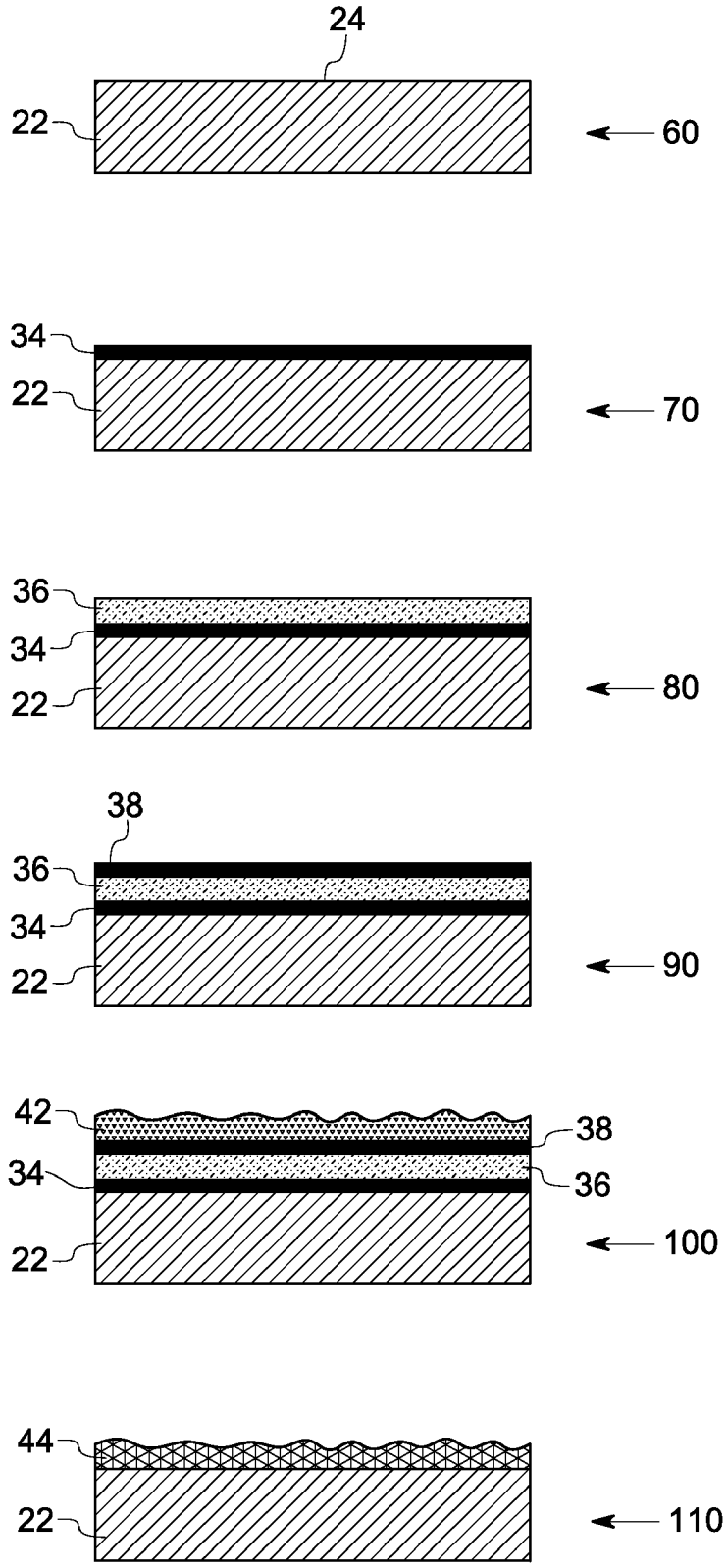
FIG. 3 is a schematic representation of a method for manufacturing an article having a wetting-resistant surface, in yet another embodiment of the present invention.

In accordance with some embodiments of the invention, a method for manufacturing an article having a wetting-resistant surface is shown in FIG. 3. At step 60, a substrate 22 having a surface 24 is provided.

A first bonding layer 34 comprising an adhesive is disposed on the surface 24 of the substrate 22, in step 70. Any adhesive may be utilized, as long as it is capable of volatilizing during the subsequent heating step. Exemplary adhesives include polyethylene oxide and acrylic materials. Commercial examples of adhesives formulated for use in brazing operations include 4B Braze Binder® available from Cotronics Corporation. The first bonding layer 34 may be applied by various techniques. For example, liquid-like adhesives may be coated or sprayed onto the surface 24. A thin mat or film with double-sided adhesion alternatively may be used, such as 3M 467® Adhesive tape.

In step 80, the braze material 36 is disposed on the first bonding layer 34. The braze material 36, in some embodiments, comprises a powder. The braze material may be sprinkled over the first bonding layer 34, in one embodiment. Alternatively, a braze tape, as noted, may be disposed on the first bonding layer 34.

A second bonding layer 38 is disposed on the braze material 36, in step 90. The second bonding layer 38 comprises an adhesive that sandwiches the braze material 36 between the first bonding layer 34 and the second bonding layer 38. The adhesive comprising the second bonding layer 38 may be similar to that of the first bonding layer 34; in any event, the list of exemplary alternatives listed above for the first bonding layer are also suitable examples for use in the second bonding layer.

A texture-providing material 42 is disposed on the second bonding layer 38, in step 100. In one embodiment, the texture-providing material 42 may be disposed on the second bonding layer 38 so as to provide a desirable alignment of the plurality of particles constituting the texture-providing material. In some embodiments, the texture-providing material 42 may be patterned over the second bonding layer 38. In one embodiment, the texture-providing material 42 is applied to the surface of the second bonding layer 38 through a screen, in a screen printing technique. The screen generally has apertures of a pre-determined size and pattern, depending on the shape and size of the protrusions desired for the wetting-resistant surface. Subsequently, the screen is removed to form the second bonding layer 38 having a pattern. By use of a screen, a pattern may be defined having a plurality of clusters spaced apart from each other by a pitch corresponding to the spacing of the openings in the screen. The texture-providing material adheres to the second bonding layer 38.

The braze material 36 is heated, in step 110, so as to melt the material constituting the braze material 36 and, on cooling, solidifies to bond the texture-providing material 42 on the surface 24 of the substrate 22. The adhesive included in the first bonding layer 34 and the second bonding layer 38 volatilizes on heating to form a wetting-resistant surface 44 comprising a braze material and a texture-providing material protruding above the surface from within the solidified braze material.

The article thus formed has a substrate and a coating disposed on the surface of the substrate, wherein the coating comprises the braze material and the texture-providing material. In some embodiments, the article further includes a base component, wherein the substrate is attached to the base component. For example, in applications where coating cannot be disposed directly to form a wetting-resistant surface, a preform comprising the substrate and the coating is prepared and this preform may be then attached to the desired surface to obtain wetting resistance. In some embodiments, the preform is a sheet or a foil. The preform may be attached using techniques known in the art, such as mechanically attaching, welding, brazing, or soldering, for example. In one embodiment, an adhesive may be utilized to bond the preform to the base component.

The texture-providing material imparts surface roughness to the wetting-resistant surface. A higher surface area enhancement may result in a more pronounced enhancement in the wetting resistance of the surface. In one embodiment, the surface area enhancement of the wetting-resistant surface is greater than about 1.2. In some embodiments, the surface area enhancement of the wetting-resistant surface is greater than about 5. In yet another embodiment, the surface area enhancement of the wetting-resistant surface is greater than about 10.

The surface roughness of the wetting-resistant surface may also depend in part on the particle density of the texture-providing material on the wetting-resistant surface. In one embodiment, the particle density of the texture-providing material is greater than about $10^5$ particles/cm$^2$. In some embodiments, the particle density of the texture-providing material is in the range from about $10^5$ particles/cm$^2$ to about $10^{15}$ particles/cm$^2$. Further, the plurality of particles constituting the texture-providing material may be provided in a particular distribution on the wetting-resistant surface to obtain the desired surface roughness. In one embodiment, the size distribution of the texture-providing material is multimodal, such as, for example, bimodal. Typically, in a bimodal or other multimodal distribution, bigger particles of the texture-providing material are bonded to the wetting-resistant surface and smaller particles are then attached on the bigger particles, which will generate multiscale roughness. This may advantageously enhance the surface roughness and provide a mechanism for further increasing wetting resistance. For example, a screen printing technique may be utilized to provide bigger particles, and smaller particles are deposited on these bigger particles before the bonding step.

In some embodiments, the wetting-resistant surface is substantially hydrophobic. The hydrophobicity of the wetting-resistant surface can be defined in terms of the contact angle. In one embodiment, the wetting-resistant surface has a contact angle with water that is greater than about 90 degrees. In some embodiments, the wetting-resistant surface has a contact angle with water that is greater than about 120 degrees. In certain embodiments, the wetting-resistant surface has a contact angle with water that is greater than about 150 degrees.

Without further elaboration, it is believed that one skilled in the art can, using the description herein, utilize the present invention to its fullest extent. The following examples are included to provide additional guidance to those skilled in the art in practicing the claimed invention. The examples provided are merely representative of the work that contributes to the teaching of the present application. Accordingly, these examples are not intended to limit the invention, as defined in the appended claims, in any manner.

EXAMPLE 1

Figure 4:
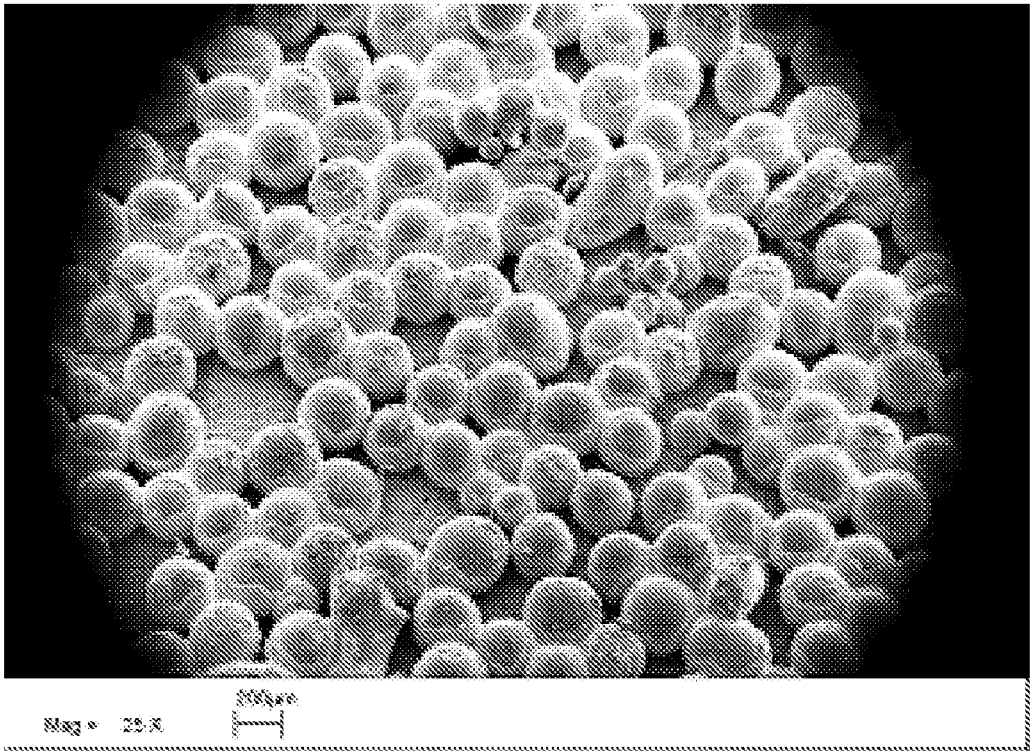
FIG. 4 is a typical scanning electron microscopy (SEM) image of a wetting-resistant surface.
Figure 5:
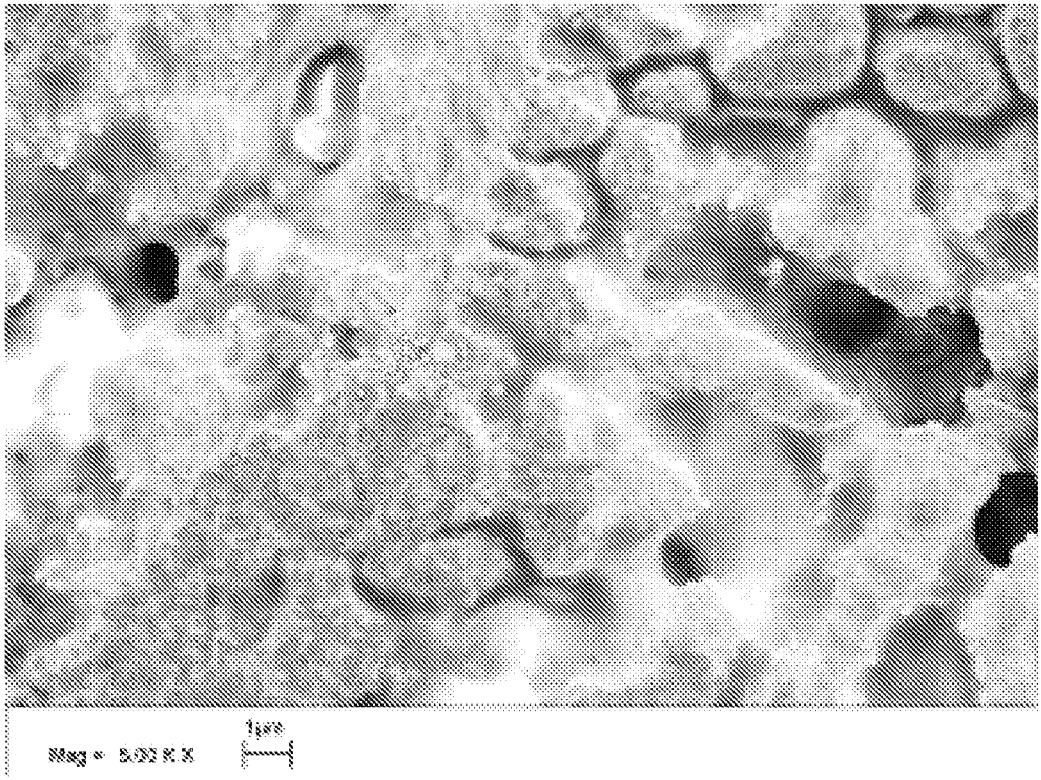
FIG. 5 is the image of the wetting-resistant surface of FIG. 4 but with higher magnification.

A 0.005 inch Amdry® 100 tape with adhesive on both sides was taken. One side of the tape was applied on a 2×2 Nickel-based superalloy substrate while the other side with the adhesive was left exposed. Alloy 718 powder was applied on the exposed portion of the tape. The excess powder on the tape was blown off such that a monolayer remains attached to the substrate. The substrate was then brazed in vacuum for 30 minutes at a temperature of about 1149° C. to form a wetting resistant-surface. The surface roughness of the resultant wetting-resistant surface of the substrate was observed using scanning electron microscopy (SEM) and the typical SEM images of the wetting-resistant surface are shown in FIGS. 4 and 5. FIG. 4 shows Alloy 718 powder on the wetting-resistant surface of the substrate. The particles ranged in diameter from about few micrometers to about 200 micrometers. From the SEM image, the surface area enhancement factor was found to be 2.2. FIG. 5 is a magnified image of FIG. 4 with a magnification factor of 200 times and shows secondary features on the surface of the Alloy 718 powder. Typical median size of the surface features were about 1 micrometer, as seen from the image. The surface of the substrate was further modified by vapor depositing a tridecafluoro 1,1,2,2-tetrahydroflouro octyl trichlorosilane (FOTS) coating. The contact angle of the FOTS coated wetting-resistant surface with water was measured and was found to be 135 degrees.

EXAMPLE 2

Figure 6:
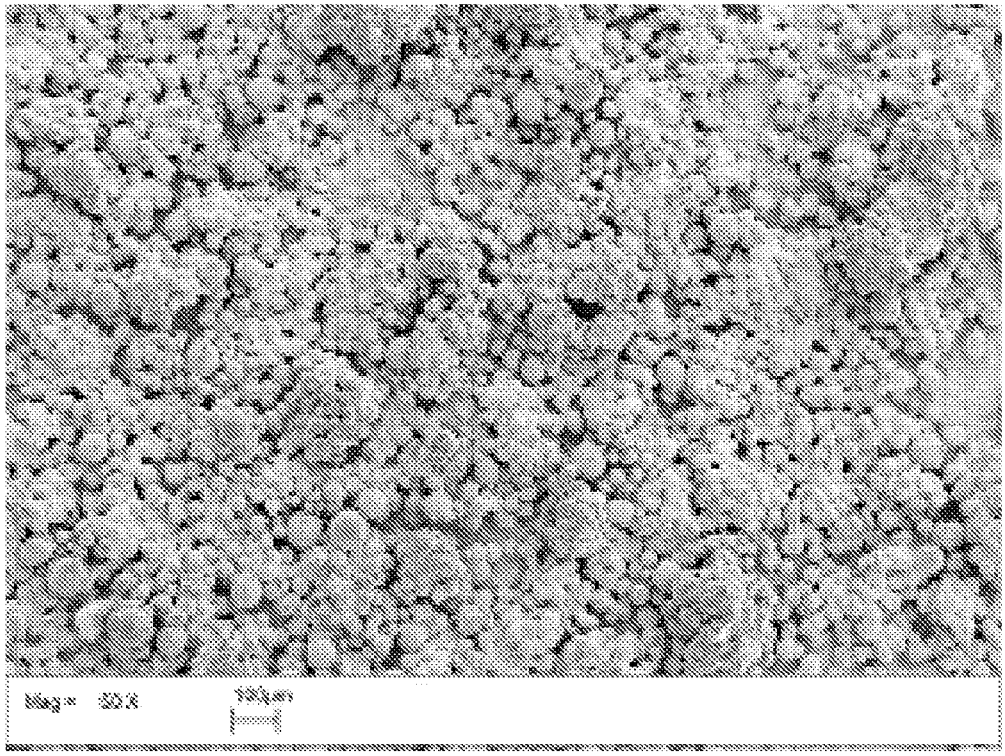
FIG. 6 is a typical SEM image of a wetting-resistant surface.
Figure 7:
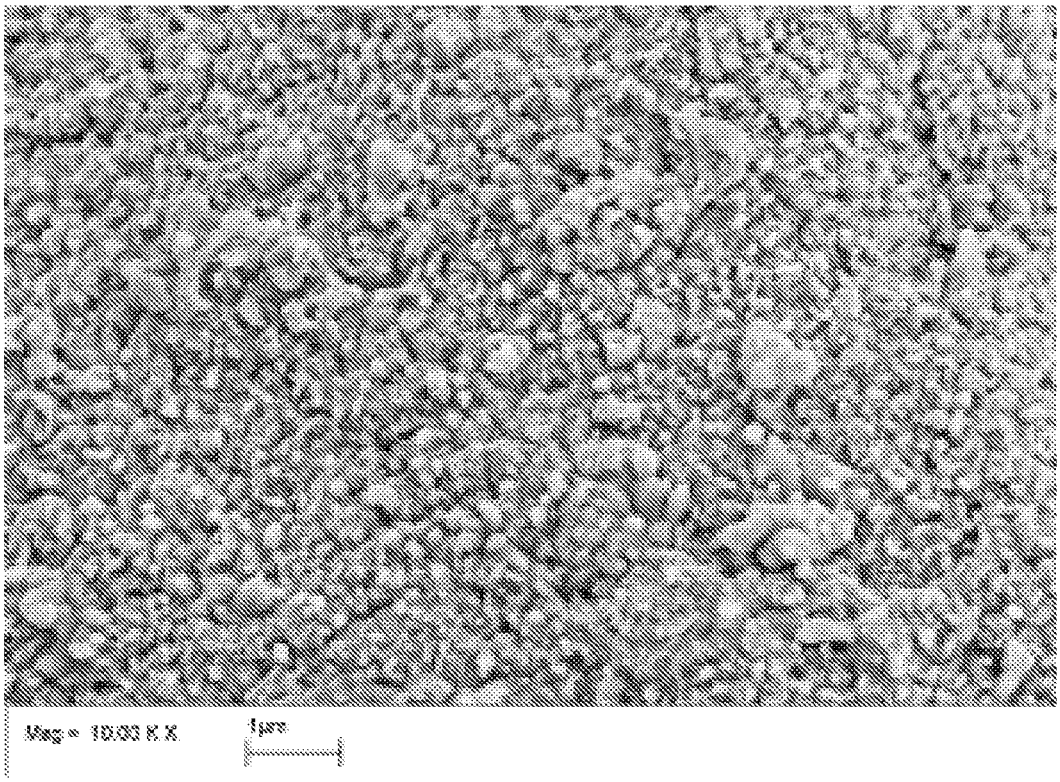
FIG. 7 is the image of the wetting-resistant surface of FIG. 6 but with higher magnification.

A 2×2 Nickel-based superalloy substrate was cleaned and coated with a light spray of 3M® Spray Adhesive 75. In a hood, the coated substrate was dusted with fine braze powder Amdry XPT-476 (−325 U.S. mesh, Ni-15Cr-3.5B). The coated surface of the substrate was further coated with a spray of 3M® Spray Adhesive 75. Praxair Powder No. NI211-17 (−325 U.S. mesh; Ni-22Cr-10Al-1Y) was applied on the surface and was subjected to brazing. Three braze runs were performed in vacuum. The first braze run was at 1055° C., the second braze run was performed at 1070° C. and the third one was performed at 1085° C. The surface roughness of the resultant wetting-resistant surface of the substrate after brazing was observed using SEM and the images are shown in FIGS. 6 and 7. FIG. 6 shows NI211-17 particles on the surface of the wetting-resistant substrate. The particles show diameter in the range from about few micrometers to about 100 micrometers. FIG. 7 is a magnified image of FIG. 6 with a magnification factor of 200 times and shows secondary features on the surface of the NI211-17 particles. Typical median size of the surface features were less than about 1 micrometer, as seen from the figure. The wetting-resistant surface of the substrate was further modified by vapor depositing FOTS to form a coating. The contact angle of the coated surface with water was measured and was found to be 148 degrees.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for manufacturing an article having a wetting-resistant surface comprising:

providing a substrate;

disposing a coating mixture on a surface of the substrate, wherein the coating mixture comprises a braze material and a texture-providing material;

heating the braze material to bond the texture-providing material to the surface of the substrate to provide a surface area enhancement of greater than about 1.2; and applying a top coat comprising diamond-like carbon, titanium oxide, tantalum oxide, titanium nitride, titanium carbo-nitride, chromium nitride, chromium carbide, boron nitride, zirconium nitride, titanium carbide, tungsten carbide, molybdenum carbide, molybdenum boride, or tungsten boride.

2. The method of claim 1, wherein the substrate comprises a ceramic or a metal.

3. The method of claim 1, wherein the article comprises a component of an aircraft.

4. The method of claim 1, wherein the article comprises a component of a turbine assembly.

5. The method of claim 1, wherein the coating mixture is substantially free of flux.

6. The method of claim 1, wherein the braze material comprises a nickel-based alloy, a cobalt-based alloy, an iron-based alloy, an aluminum-based alloy, a titanium-based alloy or a copper-based alloy.

7. The method of claim 1, wherein the texture-providing material comprises a plurality of particles having a median size of less than about 1000 micrometers in at least one dimension.

8. The method of claim 1, wherein the texture-providing material comprises a plurality of particles having a median size in the range from about 1 micrometer to about 250 micrometers in at least one dimension.

9. The method of claim 1, wherein the texture-providing material comprises a plurality of particles having a median size of less than about 1 micrometer in at least one dimension.

10. The method of claim 1, wherein the texture-providing material comprises a plurality of particles having a median aspect ratio of greater than about 1.

11. The method of claim 1, wherein the texture-providing material comprises a plurality of particles having a median aspect ratio of greater than about 10.

12. The method of claim 1, wherein the texture-providing material comprises a plurality of particles comprising a nanotube or a nanorod.

13. The method of claim 12, wherein the nanotube comprises a carbon nanotube.

14. The method of claim 1, wherein the texture-providing material comprises ceramic particles.

15. The method of claim 14, wherein the ceramic particles comprise an oxide, a mixed oxide, a nitride, a boride or a carbide.

16. The method of claim 14, wherein the texture-providing material comprises boron nitride.

17. The method of claim 1, wherein the texture-providing material comprises metallic particles.

18. The method of claim 1, wherein the texture-providing material comprises intermetallic particles.

19. The method of claim 18, wherein the intermetallic particles comprise a silicide, an aluminide or any combinations thereof.

20. The method of claim 1, wherein the texture-providing material comprises a material having an inherent contact angle that is greater than about 90 degrees.

21. The method of claim 20, wherein the texture-providing material comprises a material having an inherent contact angle that is greater than about 100 degrees.

22. The method of claim 1, wherein the texture-providing material comprises particles comprising surface features disposed on their surfaces, wherein the surface features have a median size of less than about 10 micrometers.

23. The method of claim 1, wherein disposing the coating mixture on the surface of the substrate comprises:

providing a first coating comprising a braze material on the surface of the substrate; and disposing a second coating comprising the texture-providing material on the first coating.

24. The method of claim 1, wherein disposing the coating mixture on the surface of the substrate comprises:

providing a first bonding layer comprising an adhesive on the surface of the substrate;

disposing the braze material on the first bonding layer;

providing a second bonding layer comprising an adhesive on the braze material; and disposing the texture-providing material on the second bonding layer.

25. The method of claim 1, wherein heating the braze material to bond the texture-providing material to the surface comprises providing a temperature greater than about 450 degrees Celsius so as to melt the braze material.

26. The method of claim 1, wherein the wetting-resistant surface has a contact angle with water greater than about 90 degrees.

27. The method of claim 1, wherein a particle density of the texture-providing material on the wetting-resistant surface is greater than about $10^5$ particles/$cm^2$.

28. The method of claim 27, wherein the particle density of the texture-providing material on the wetting-resistant surface is in the range from about $10^5$ particles/$cm^2$ to about $10^{15}$ particles/$cm^2$.

29. The method of claim 1, wherein the texture-providing material comprises a plurality of particles having a multimodal size distribution.

30. A method for manufacturing an article having a wetting-resistant surface comprising:

providing a substrate;

disposing a coating mixture on a surface of the substrate, the coating mixture comprising a braze material and a texture-providing material, wherein the texture-providing material comprises a plurality of particles having a median size of less than about 1 micrometer in at least one dimension;

heating the braze material to bond the texture-providing material to the surface of the substrate; and applying a top coat comprising diamond-like carbon, titanium oxide, tantalum oxide, titanium nitride, titanium carbo-nitride, chromium nitride, chromium carbide, boron nitride, zirconium nitride, titanium carbide, tungsten carbide, molybdenum carbide, molybdenum boride or tungsten boride.

31. The method of claim 30, wherein the coating mixture is substantially free of flux.

32. The method of claim 30, wherein the plurality of particles has a median aspect ratio of greater than about 1.

33. The method of claim 30, wherein the plurality of particles comprises a nanotube or a nanorod.

34. The method of claim 30, wherein a particle density of the texture-providing material on the wetting-resistant surface is greater than about $10^5$ particles/$cm^2$.

35. The method of claim 30, wherein the texture-providing material comprises particles comprising surface features disposed on their surfaces.

36. The method of claim 30, wherein the wetting-resistant surface has a contact angle with water greater than about 90 degrees.

37. A method for manufacturing an article having a wetting-resistant surface comprising:

providing a substrate;

disposing a coating mixture on a surface of the substrate, wherein the coating mixture comprises a braze material and a texture-providing material, wherein the texture-providing material comprises a plurality of particles having surface features disposed on a surface of the plurality of particles;

heating the braze material to bond the texture-providing material to the surface of the substrate; and applying a top coat comprising diamond-like carbon, titanium oxide, tantalum oxide, titanium nitride, titanium carbo-nitride, chromium nitride, chromium carbide, boron nitride, zirconium nitride, titanium carbide, tungsten carbide, molybdenum carbide, molybdenum boride or tungsten boride.

38. The method of claim 37, wherein the coating mixture is substantially free of flux.

39. The method of claim 37, wherein the braze material comprises a nickel-based alloy, a cobalt-based alloy, an iron-based alloy, an aluminum-based alloy, a titanium-based alloy or a copper-based alloy.

40. The method of claim 37, wherein the texture-providing material comprises ceramic particles.

41. The method of claim 40, wherein the ceramic particles comprise an oxide, a mixed oxide, a nitride, a boride or a carbide.

42. The method of claim 37, wherein the texture-providing material comprises metallic particles.

43. The method of claim 37, wherein the texture-providing material comprises intermetallic particles.

44. The method of claim 37, wherein the texture-providing material comprises a material having an inherent contact angle that is greater than about 90 degrees.

45. The method of claim 37, wherein the surface features have a median size of less than about 10 micrometers.

46. The method of claim 37, wherein the wetting-resistant surface has a contact angle with water greater than about 90 degrees.

47. The method of claim 37, wherein a particle density of the texture-providing material on the wetting-resistant surface is greater than about $10^5$ particles/$cm^2$.

* * * * *

UNITED STATES PATENT AND TRADEMARK OFFICE

CERTIFICATE OF CORRECTION

PATENT NO. : 7,919,151 B2
APPLICATION NO. : 11/610542
DATED : April 5, 2011
INVENTOR(S) : Deng et al.

It is certified that error appears in the above-identified patent and that said Letters Patent is hereby corrected as shown below:

On the Title Page, in Item (75), under "Inventors" in Column 1, Line 4, delete "Niskayana," and insert -- Niskayuna, --, therefor.

Signed and Sealed this
Twelfth Day of July, 2011

David J. Kappos

David J. Kappos
*Director of the United States Patent and Trademark Office*